US008555629B2

(12) United States Patent
Stürmer et al.

(10) Patent No.: US 8,555,629 B2
(45) Date of Patent: Oct. 15, 2013

(54) HYDROSTATIC PUMP

(75) Inventors: Burkhard Stürmer, Kleinostheim (DE); Christoph Kempermann, Aschaffenburg (DE)

(73) Assignee: Linde Hydraulics GmbH & Co. KG, Aschaffenburg (DE)

( * ) Notice: Subject to any disclaimer, the term of this patent is extended or adjusted under 35 U.S.C. 154(b) by 817 days.

(21) Appl. No.: 12/784,569

(22) Filed: May 21, 2010

(65) Prior Publication Data

US 2010/0300084 A1 Dec. 2, 2010

(30) Foreign Application Priority Data

May 26, 2009 (DE) ..... 10 2009 022 674
Sep. 30, 2009 (DE) ..... 10 2009 043 757

(51) Int. Cl.
*F16D 31/02* (2006.01)

(52) U.S. Cl.
USPC ..... 60/447; 60/444; 60/488

(58) Field of Classification Search
USPC ..... 60/406, 443, 444, 447, 465, 487, 488; 91/360, 504, 505, 506
See application file for complete search history.

(56) References Cited

U.S. PATENT DOCUMENTS 3,650,108 A * 3/1972 Isaac ..... 60/447
4,215,547 A * 8/1980 Molby ..... 60/465
4,559,778 A * 12/1985 Krusche ..... 60/447
5,881,629 A * 3/1999 Gollner et al. ..... 91/505

FOREIGN PATENT DOCUMENTS

DE 39 03 189 A1 8/1990

* cited by examiner

*Primary Examiner* — Michael Leslie
(74) *Attorney, Agent, or Firm* — The Webb Law Firm

(57) ABSTRACT

A hydrostatic pump (1) with a variable delivery volume can be operated in a closed circuit. An electrically controllable actuator device (4) is provided for the control of the delivery volume of the pump (1). The electrically controllable actuator (4) has an electrically actuatable control valve device (6) which generates a positioning pressure which actuates a positioning piston device (5) which is in an operative connection with a delivery volume control device (3) of the pump. An electrical position feedback circuit (21) of the delivery volume control device (3) is provided and the actuator device (4) is provided with a switchable hydraulic neutral position control system (25), by means of which a restoring movement can be generated that acts on the positioning piston device (5) and places the delivery volume control device (3) into a neutral position.

28 Claims, 2 Drawing Sheets

HYDROSTATIC PUMP

CROSS REFERENCE TO RELATED APPLICATIONS

Figure 1:
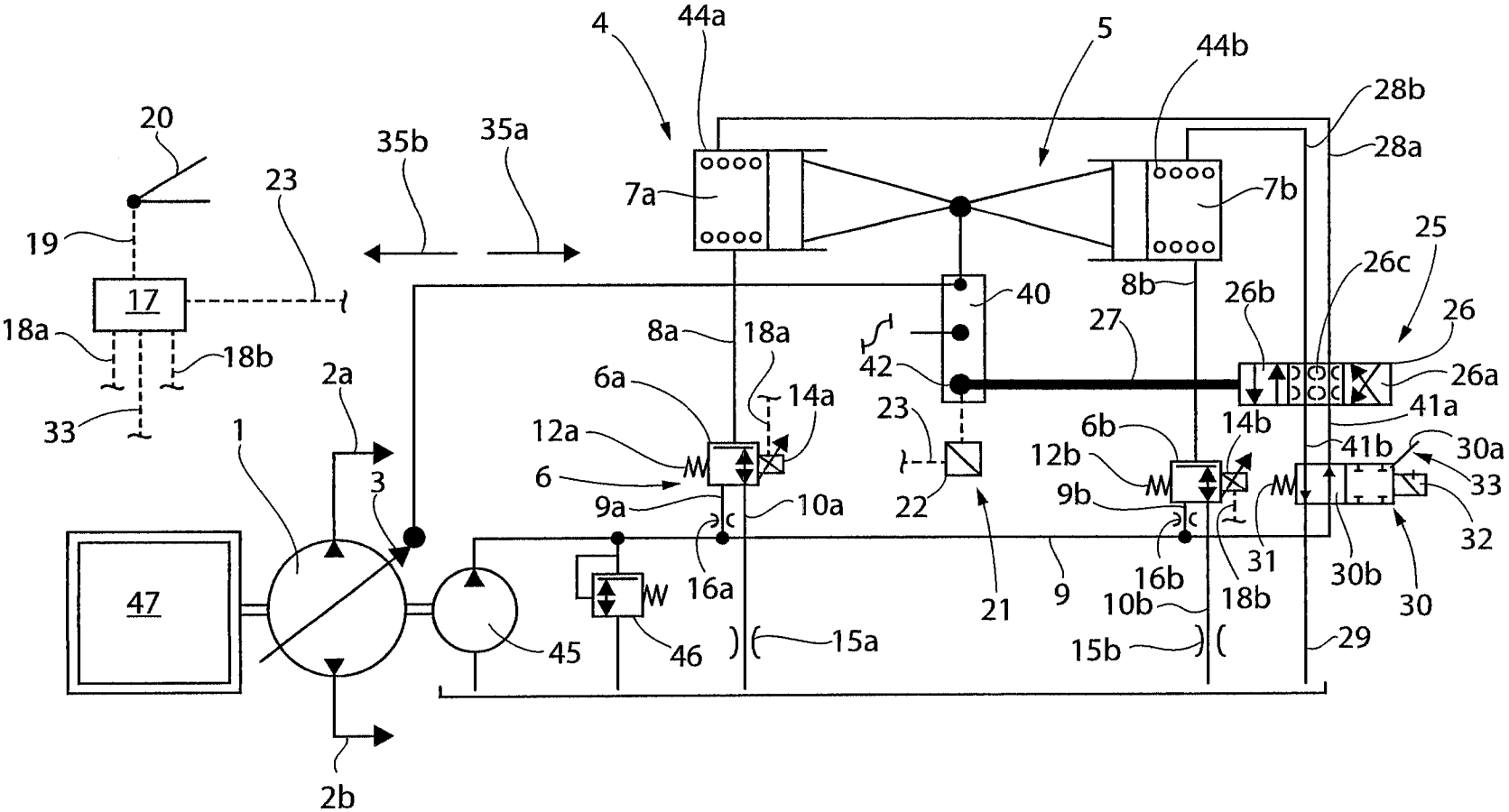

This application claims priority to German Application DE 102009022674.5, filed May 26, 2009 and German Application DE 102009043757.6, filed Sep. 30, 2009, which are herein incorporated by reference in their entireties.

BACKGROUND OF THE INVENTION

1. Field of the Invention

This invention relates to a hydrostatic pump with a variable delivery volume which can be operated in a closed circuit. An electrically actuatable control device is provided for the control of the delivery volume of the pump.

2. Description of Related Art

Pumps of the above general type are used as hydrostatic drive systems in a closed circuit to supply hydrostatic traction drives or slewing gear drive systems in mobile work machines. When the pump has an electrically actuatable control device, the pump can be easily incorporated into a vehicle management system.

On known pumps for use in a closed circuit, the electrically actuatable control device has electrically actuatable pilot valves in the form of solenoid valves, by means of which a control pressure can be generated. The control pressure is exerted on a servo device that consists of a slave piston. The slave piston is in communication by means of a linkage with a position-controlled control valve in the form of a pilot valve which controls the application of a positioning pressure to a positioning piston device which is operatively connected to a delivery volume control device such as a pivoting cradle in the form of a swashplate. For this purpose, the pilot valve is in communication on the input side with a reservoir and a control pressure source. The feedback of the position of the delivery volume control device takes place on a movable sleeve of the pilot valve formed by the control valve. With an electrically actuatable control device of this type, the delivery volume of the pump and the delivery direction of the pump can be controlled by an electrical actuation signal to the solenoid valve.

As a result of the presence of the position-controlled pilot valve, on which a mechanical displacement equalization is performed to control the position of the delivery volume control device, and as a result of the presence of the slave piston, a pump of this type with an electrical actuation increases the construction cost of the closed circuit. A pump of this type for a closed circuit with an electrically actuated control device and a mechanical displacement equalization of the position control is described in DE 39 03 189 A1.

On pumps of this type which are used for hydrostatic traction drives in the closed circuit of mobile work machines, for certain applications with a high safety standard, such as the requirement for certification of the mobile equipment under federal motor vehicle safety standards, to ensure that in the event of a defect or malfunction in the electrical control system the pump is pivoted actively and in a controlled manner back into the neutral position, which is also designated as the zero position, in which the pump does not deliver any discharge flow, to achieve a controlled deceleration of the mobile work machine. With a position-controlled pilot valve on known pumps, the pump can be pivoted back into the neutral position that represents the zero position. In addition, it is already known that for such a safety function a restoring spring device can be provided which pivots the delivery volume control device of the pump back into the neutral position. However, a restoring spring device of this type results in high construction costs and takes up a great deal of room on the pump.

Therefore, it is an object of this invention to provide a pump of the general type described above but which is economical to manufacture and is provided in a simple manner with a safety function to ensure that the pump pivots back into the neutral position in a controlled and active manner.

SUMMARY OF THE INVENTION

The invention teaches that the electrically actuated control device has an electrically controllable control valve device which generates a positioning pressure which acts on a positioning piston which is operatively connected with a delivery volume control device of the pump. An electrical position feedback circuit of the delivery volume control device is provided, and the control device is provided with a switchable hydraulic neutral position control system by means of which a restoring torque is generated on the positioning piston device that moves the delivery volume control device into a neutral position.

According to the invention, on a pump with an electrical positioning of the electrically actuated control valve device, a positioning pressure is generated that directly moves the positioning piston device and thereby generates the control torque of the delivery volume control device which pivots the pump, and provides an electrical position feedback circuit with an electrical displacement equalization for the position control of the delivery volume control device of the pump. As a result, a position-controlled pilot valve and a slave piston are no longer necessary, as a result of which the pump of the invention is characterized by a simple and economical construction. Moreover, with the pump of the invention, for the safety function by means of which the pump is actively pivoted in a controlled manner back into the neutral position, which is the zero position, and in which position the pump does not deliver any discharge flow, a switchable hydraulic neutral position control system is used, by means of which a restoring torque can be generated directly on the positioning piston device to move the delivery volume control device into the neutral position, which is the zero position, actively and in a controlled manner, as a result of which the safety function can also be achieved simply and with little construction effort or expense.

In one advantageous embodiment of the invention, the control device can be switched between the electrical actuation and the hydraulic neutral position control system. In normal operation, the pump can be operated by an electrical actuation of the control valve device and of the electrical displacement feedback of the delivery volume control device by means of the position feedback circuit with an electro-hydraulic position control system with an electrical displacement equalization. In emergency operation, for example, in the event of a power failure in which the electrical displacement feedback does not supply a signal, the pump is switched to the hydraulic neutral position control system to achieve a safe and precise return of the delivery volume control device into the neutral position.

In one advantageous embodiment of the invention, the pump can be adjusted in both directions in its delivery volume. The positioning piston device has a first control pressure chamber which moves the delivery volume control device in the direction of a first delivery direction and has a second control pressure chamber which moves the delivery volume control device in the direction of a second delivery direction.

By means of the electrically actuatable control valve device, a positioning pressure which is present in the first control pressure chamber and the second control pressure chamber can be generated. With an electrically actuated control device of this type, the construction cost of a pump that can be adjusted in both directions, by means of which, in a hydrostatic traction drive in a closed circuit, forward travel and reverse travel can both be controlled, can be kept low.

In one advantageous configuration of the invention, the control valve device has a first control valve which is connected to a first control pressure line that leads to the first control pressure chamber, and a second control valve which is connected to a second control pressure line that leads to the second control pressure chamber. The control valves are each in communication with a control pressure supply branch line and a reservoir branch line and can be actuated by means of an electrical actuation device. With two electrically actuated control valves, it is easily possible to generate a positioning pressure in each of the corresponding control pressure chambers of the positioning piston device for the pivoting of the pump.

In one configuration of the invention, the positioning piston device can be formed by two single-acting positioning pistons, in particular spring-loaded positioning pistons.

In an alternative configuration of the invention, however, it is also possible for the positioning piston device to have one double-acting positioning piston, such as a spring-loaded positioning piston.

The control valves can be moved by means of a spring device into a control position that connects the control pressure line with the reservoir branch line and by means of an actuation device toward a control position in which the control pressure line is connected with the control pressure supply branch line. The result is a high level of operational reliability, because when the control valves are not actuated, the control pressure lines are discharged into the reservoir.

The actuation devices are particularly advantageously each formed by an actuator magnet. With actuator magnets it is easily possible, in an electrically actuated control device, to precisely control the delivery volume of the pump by means of an electrical control signal.

For the electrical position feedback circuit of the delivery volume control device, the invention results in a low construction cost if, as in one embodiment of the invention, the electrical position feedback circuit has a sensor device which is in an operative connection with the delivery volume control device of the pump. The sensor device is in communication on the input side with an electronic control device which is in connection on the input side with a setpoint input device and on the output side with the electrically actuatable control valve device. With the electronic control device which detects the setpoint for the delivery of the pump and which detects the actual value of the delivery volume of the pump and, thus, the sensor device that reports back the position of the delivery volume control device, an electrical closed-loop control circuit can be achieved to control the delivery volume of the pump with an electrical position feedback and, thus, an electrical displacement feedback of the delivery volume control can be achieved easily and economically, whereby an electrical displacement equalization is performed in the electronic control device.

In one embodiment of the invention, the switchable hydraulic neutral position control system has a restoring valve which is in an operative connection with the delivery volume control device of the pump. By means of the restoring valve the restoring torque that moves the delivery volume control device into the neutral position can be generated on the positioning piston device. With a restoring valve of this type which is in an operative connection with the delivery volume control device of the pump, as a result of which the hydraulic neutral position control system has a mechanical displacement feedback for a mechanical position control of the delivery volume control device of the pump, a restoring torque on the positioning piston device for the active and controlled pivoting of the pump back into the neutral position, which is the zero position, and, thus, the safety function can be achieved at a low construction cost.

The restoring valve can be particularly advantageously connected to the first control pressure line and the second control pressure line, and can be brought into communication with a reservoir line and a control pressure supply line. Consequently it is easily possible, by means of the restoring valve, to connect the corresponding control pressure chamber of the positioning piston device to the control pressure supply line, so that the restoring torque that pivots the pump back into the neutral position can be generated in the corresponding control pressure chamber of the positioning piston device.

It is particularly advantageous if the restoring valve is in an operative connection with the delivery volume control device so that when the delivery volume control device is in a neutral position, the restoring valve is in a neutral position, and when there is a positioning pressure present in the first control pressure line is moved in the direction of a first switched position in which the first control pressure line can be brought into an operative connection with the reservoir line and the second control pressure line can be brought into an operative connection with the control pressure supply line, and when there is a positioning pressure present in the second control pressure line it can be moved toward a second switched position, in which the second control pressure line can be brought into communication with the reservoir line and the first control pressure line can be brought into communication with the control pressure supply line. With a restoring valve of this type in the form of a three-position valve, it is easily possible to achieve a hydraulically position-controlled neutral position of the pump with a mechanical displacement equalization, so that in the event of a failure or malfunction, the pump can be pivoted correctly back into the neutral position to achieve the safety function.

In one embodiment of the invention, the mechanical operative connection of the restoring valve with the delivery volume control device of the pump to the mechanical displacement feedback on the restoring valve and, thus, for the mechanical position control of the hydraulic neutral position control system is achieved in that the restoring valve is in an operative communication with the delivery volume control device by means of the equalization device, such as, a lever device.

If the restoring valve has a control slide and a control sleeve and the control slide is connected with the delivery volume control device of the pump by means of the equalization device, as the result of an adjustment, for example a displacement, of the control sleeve in a casing of the pump, the neutral position of the pump can be set to achieve a correct neutral position of the pump, which is the zero position, in which the delivery volume control device is at the pivot angle zero and the pump is not delivering any discharge flow.

If, as in one embodiment of the invention, the restoring valve, in particular a control slide of the restoring valve, is connected with the equalization device by means of a linkage, a setting of the neutral position of the pump can easily be achieved by modifying the coupling point of the linkage to the equalization device. By a correction of the coupling point of the linkage to the equalization device, for example an eccentric engagement of the linkage on the equalization device, it is easily possible to set the neutral position of the pump, which is the zero position, so that with the hydraulic neutral position control system a correct neutral position of the pump can be achieved in which the delivery volume control device is at the pivot angle zero and the pump does not deliver any discharge flow.

In one development, an electrically actuatable switching valve device is provided for the switching of the hydraulic neutral position control system. With a switching valve device of this type, the pump can easily be switched from the electro-hydraulic position control system with an electrical displacement equalization to the hydraulic neutral position control system with a mechanical position control, so that in the event of a failure or malfunction, i.e., in an emergency, the pump can be actively pivoted back in a controlled manner into the neutral position to implement the safety function.

The switching valve device controls the connections that can be controlled by the restoring valve of the control pressure lines with the reservoir line and the control pressure supply line.

The switching valve device can be located in the connection of the restoring valve with the control pressure lines. With regard to a simple construction, it is advantageous if the switching valve device controls the connection of the restoring valve with the control pressure supply line and the reservoir line.

For this purpose, the restoring valve is in communication, such as by means of a first connecting line and a second connecting line, with the switching valve device. The switching valve device is in communication with the control pressure supply line and the reservoir line. The switching valve device can therefore control the connection of the restoring valve with the control pressure supply line and the reservoir line in a simple manner.

In one advantageous embodiment of the invention, the switching valve device has an operating position in which the first connecting line of the restoring valve and the second connecting line of the restoring valve are cut off, and a safety position in which the first connecting line of the restoring valve is connected with the control pressure supply line and the second connecting line of the restoring valve is connected with the reservoir line. With a switching valve of this type realized in the form of a two-position valve, it becomes easily possible to control the connection of the restoring valve with the reservoir and with the control pressure supply to activate the hydraulic neutral position control system in the safety position of the switching valve device, and to deactivate the hydraulic neutral position control system in the operating position of the switching valve device.

The control pressure supply branch lines of the control valves can be connected to the control pressure supply line and the reservoir branch lines of the control valves can be connected to a reservoir. On account of the continuous connection of the electrically actuatable control valves to the control pressure supply line and the reservoir line, the hydraulic neutral position control system (formed by the restoring valve and the switching valve device) overdrives the electro-hydraulic position control system with electrical displacement equalization (formed by the switching valves and the electrical position feedback circuit).

If, as in one embodiment of the invention, a flow restrictor device is located in both the control pressure supply branch line and/or in the reservoir branch lines of the control valves, a volume flow restriction of the control valves in admission and discharge can easily be achieved, to thereby ensure that the pump is pivoted back by the hydraulic neutral position control system.

It is particularly advantageous if the connection of the control valves with the control pressure supply line and the reservoir line can be controlled by means of the switching valve device. The switching valve device of the neutral position control system thus also controls the connection of the electrically actuatable control valves with the control pressure supply line and the reservoir line. Consequently, the pump can be switched between the electro-hydraulic position control system with electrical displacement equalization formed by the control valves and the electrical position feedback circuit and the neutral position control system with mechanical position control formed by the restoring valve and the switching valve device.

The switching valve device is connected to the control pressure supply branch lines of the control valves and to the reservoir branch lines of the control valves, whereby in the operating position, the switching valve device connects the control pressure supply branch lines of the control valves with the control pressure supply line and the reservoir branch lines of the control valves with the reservoir line, and in the safety position cuts off the connection of the control pressure supply branch lines of the control valves to the control pressure supply line as well as the connection of the reservoir branch lines of the control valves to the reservoir line.

It is particularly advantageous if the switching valve device is in the operating position in normal operation and can be moved into the safety position in the event of an operational failure or malfunction. In normal operation, therefore, the switching valve device in the operating position achieves an operation of the pump by an electrical actuation of the control valves, and, thus, the pump operates with the electro-hydraulic position control system with electrical displacement equalization. In the event of a malfunction, in particular a power failure in which the electrical position feedback circuit does not deliver any signal, the movement of the switching valve device into the safety position switches the pump to the hydraulic neutral position control system with a mechanical displacement equalization, to achieve a safe switching of the pump into the neutral position, which is the zero position.

It is particularly advantageous if the switching valve device is moved into the safety position by means of a spring device and can be moved toward the operating position by means of an actuation device. Consequently, a high level of operating safety can be achieved, because in the event of a malfunction such as a power failure, a short circuit or a cable break, for example, the switching valve device is moved by the spring into the safety position and thus the pump is switched to the hydraulic neutral position control system, so that the safety function can be activated by an active and controlled pivoting of the pump back into the neutral position.

The actuation device can be in the form of an electrical actuation device or in the form of a hydraulic actuation device, or in the form of a pneumatic actuation device or in the form of a mechanical actuation device.

The actuation device is in the form of an actuating magnet which is connected with the electronic control device, as a result of which the actuation of the switching valve can be constructed at a low cost.

Particular advantages can be achieved on a hydrostatic traction drive of mobile work machine with a hydrostatic pump of the invention and at least one hydrostatic motor connected to the pump in the closed circuit. With the pump of the invention, a simply constructed electrically controlled actuating device for the control of the direction and speed of travel of the work machine can be achieved, whereby by means of the switchable hydraulic position-controlled neutral position of the pump, when the hydraulic neutral position control system is activated, in the event of a malfunction, the mobile work machine can be decelerated in a controlled manner until it comes to a stop by the active and controlled pivoting of the pump back into the neutral position, which is the zero position, and thus with a low construction effort and expense a safety function can be achieved for high safety standards, such as a certification of the mobile work machine in accordance with federal road safety standards.

Additional advantages and details of the invention are explained in greater detail below with reference to the exemplary embodiment illustrated in the accompanying illustration.

BRIEF DESCRIPTION OF THE DRAWING(S)

Figure 2:
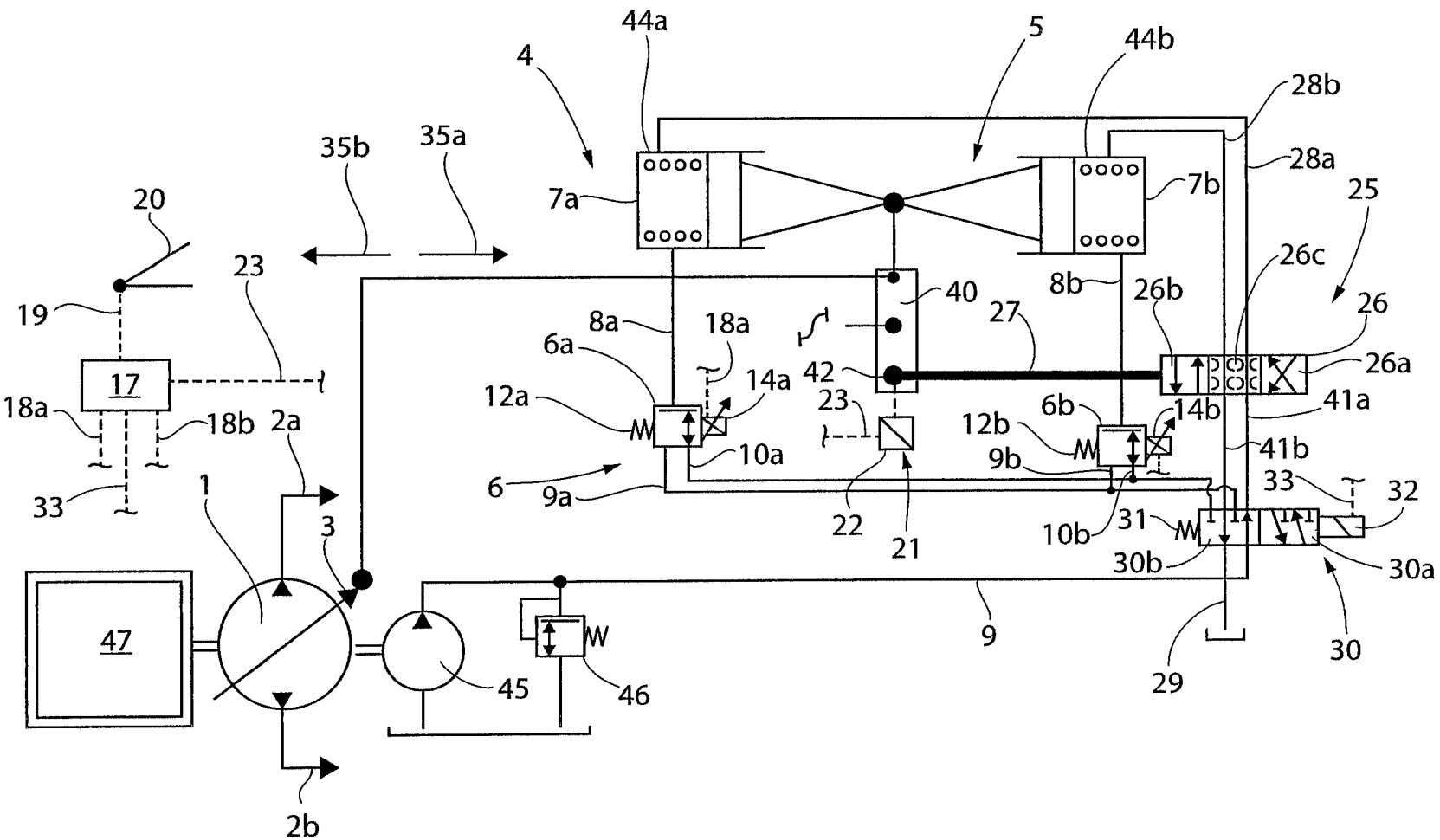

FIG. 1 is a circuit diagram including a first embodiment of a pump of the invention; and FIG. 2 is a circuit diagram including a second embodiment of a pump of the invention.

DESCRIPTION OF THE PREFERRED EMBODIMENT(S)

FIG. 1 shows a circuit diagram of a hydrostatic drive system, such as a traction drive of a mobile work machine, for example, with a pump 1 of the invention which is operated in a closed circuit.

The pump 1 is driven by a drive motor 47 such as an internal combustion engine, for example, and is in communication by means of a first delivery line 2*a* and a second delivery line 2*b* which form the closed circuit of the drive system with at least one hydrostatic motor which is not illustrated in any further detail.

The pump 1 is in the form of a bidirectionally adjustable variable displacement pump with adjustable and variable delivery volume and has a delivery volume control device 3, such as a swashplate in the form of a cradle, for example, which is operatively connected with an electrically actuatable control device 4 for the adjustment of the delivery volume and, thus, for the setting of the pump delivery.

The control device 4 has a positioning piston device 5 which, for the adjustment of the delivery of the pump 1, is connected with the delivery volume control device 3 which is in the form of a cradle. An electrically actuatable control valve device 6 is provided for the generation of a positioning pressure that moves the positioning piston device 5.

For the bidirectional adjustment of the pump 1, the positioning piston device 5 in FIG. 1 has a double-acting positioning piston on which two control pressure chambers 7*a*, 7*b* that act in opposite directions are located. The first control pressure chamber 7*a* formed on the positioning piston device 5 moves the delivery volume control device 3 of the pump 1 in a first delivery direction 35*a*. The second control pressure chamber 7*b* formed on the positioning piston device 5 moves the delivery volume control device 3 of the pump 1 in a second delivery direction 35*b*. In each of the control pressure chambers 7*a*, 7*b* there is also a spring device 44*a*, 44*b* for the centering of the positioning piston device 5 and thus of the delivery volume control device 3 in the illustrated neutral position, which is the zero position, of the delivery volume control device 3, in which the pump 1 has a pivoting angle of 0 degrees and does not deliver any discharge flow into the delivery lines 2*a*, 2*b*.

For the control of the pressurization of the control pressure chambers 7*a*, 7*b* of the positioning piston 5 with a corresponding positioning pressure, the electrically actuatable control valve device 6 has two electrically actuatable control valves 6*a*, 6*b* which can be formed, for example, by 3-way proportional pressure reducing valves.

The first control valve 6*a* controls the pressurization of the first control pressure chamber 7*a* of the positioning piston 5 with a positioning pressure and is connected to a control pressure line 8*a* that leads to the first control pressure chamber 7*a*. The first control valve 6*a* is also connected to a control pressure supply branch line 9*a* and a reservoir branch line 10*a* that leads to a reservoir. Accordingly, the second control valve 6*b* controls the pressurization of the second control pressure chamber 7*b* of the positioning piston 5 with a positioning pressure and is connected to a control pressure line 8*b* that leads to the second control pressure chamber 7*b*. The second control valve 6*b* is also connected to a control pressure supply branch line 9*b* and a reservoir branch line 10*b* that leads to a reservoir. The control pressure supply lines 9*a*, 9*b* are in communication with a control pressure supply line 9 which can be, for example, a delivery line of a feed pump 45 which is also driven by the drive motor 47. The feed pressure supply line 9 is in this case associated with a pressure limiting device 46 to limit the feed pressure.

The two control valves 6*a*, 6*b* are each moved by means of a spring device 12*a*, 12*b* into a control position in which the corresponding control pressure line 8*a*, 8*b* is connected with the reservoir line 10*a*, 10*b* and the control pressure chamber 7*a*, 7*b* is therefore relieved to the reservoir. The control valves 6*a*, 6*b* can also be moved into this control position by the positioning pressure present in the control pressure line 8*a*, 8*b*, whereby a control line that branches off from the control pressure line 8*a*, 8*b* and is not illustrated in any further detail leads to a corresponding control surface of the control valves 6*a*, 6*b*. By means of an electrical actuation device 14*a*, 14*b* in the form of an actuator magnet, the control valves 6*a*, 6*b* can be actuated for the generation of a positioning pressure that pressurizes the corresponding control pressure chambers 7*a*, 7*b*, each in the direction of a control position that connects the control pressure line 8*a*, 8*b* with the control pressure supply line 9*a*, 9*b*.

In each of the reservoir branch lines 10*a*, 10*b* of the control valves 6*a*, 6*b* there is a flow restrictor device 15*a*, 15*b*, for example, a diaphragm or throttle. In addition, a flow restrictor device 16*a*, 16*b* can be located in each of the control pressure supply branch lines 9*a*, 9*b* of the control valves 6*a*, 6*b*, for example a diaphragm or throttle.

The electrical actuation devices 14*a*, 14*b* of the control valves 6*a*, 6*b*, for the purpose of their actuation, are in communication with an electrical actuation signal on the output side with an electronic control device 17 by means of corresponding actuation lines 18*a*, 18*b*. The control device 17 is in communication on the input side via a control line 19 with a setpoint input device 20 such as an accelerator pedal.

The pump 1 is provided with an electrical position feedback circuit 21 for the delivery volume control device 3, which has a sensor device 22 which is in an operative connection with the delivery volume control device 3 and detects its position, and the sensor device 22 is in communication by means of a corresponding control line 23 with the electronic control device 17. The sensor device 22 thereby detects, for example, the pivot angle around a pivoting axis S of the delivery volume control device 3 which is in the form of a cradle or the actuation displacement of a linkage 27.

The electrically actuatable control device 4 with the electrically actuated control valves 6*a*, 6*b* for the generation of the positioning pressure that pressurizes the control pressure chambers 7*a*, 7*b* and the electrical position feedback circuit 21 form an electro-hydraulic position control system of the delivery volume control device 3 with an electrical displacement equalization.

The electrical position feedback circuit 21 does not supply a signal in the event of a failure or malfunction, in particular in the event of a power failure. In the event of such an anomaly, to achieve a return of the delivery volume control device 3 of the pump 1 into the neutral position, which is the zero position, the pump 1 is provided with a switchable hydraulic neutral position control system 25 with a mechanical displacement feedback system, by means of which a hydraulic restoring torque can be generated on the positioning piston device 5 which moves the delivery volume control device 3 of the pump into the neutral position, which is the zero position, and in which the pump 1 does not deliver any discharge flow.

To generate the restoring torque that counteracts the control torque on the positioning piston devices, the hydraulic neutral position control system 25 has a restoring valve 26 which is in operative communication with the delivery volume control device 3 for the mechanical actuation and thus for the mechanical displacement feedback, for example by means of a corresponding linkage 27. The linkage 27 is connected with a equalization device 40 which can be in the form of a lever, for example, which is mounted on the delivery volume control device 3 which is realized in the form of a cradle so that it can pivot around the pivoting axis S. The linkage 27 which is connected with a control slide of the restoring valve 26 is linked by means of a coupling point 42 to the equalization device 40.

The positioning piston 5 is connected in the central area to the equalization device 40 which is in the form of a two-armed lever, whereby the lever arm that faces the pivoting axis S is mechanically connected by means of the linkage 27 which is connected at the coupling point 42 with the restoring valve 26. In place of the equalization device 40 in the form of a lever, other embodiments can also be considered which make possible, in the neutral position, which is the zero position, of the positioning piston 5 or of the delivery volume control device 3, in which the pump 1 does not deliver any discharge, for example when the swashplate is at a pivot angle of 0 degrees, an actuation of the restoring valve 26 into a neutral position 26*c* and thus an equalization on the restoring valve 26 into a neutral position 26*c* and thus an equalization to the restoring valve 26.

The restoring valve 26 is in the form of a three-position valve and is in communication by means of branch lines 28*a*, 28*b* with the control pressure lines 8*a*, 8*b* and thus the control pressure chambers 7*a*, 7*b* of the positioning piston 5, and can be placed in communication with the control pressure supply line 9 and a reservoir line 29 that leads to the reservoir.

An electrically actuatable switching valve device 30 is provided for the activation and deactivation of the neutral position control system 25 and thus for the switchover to the hydraulic neutral position control system 25. The switching valve device 30 is formed by a switching valve which is connected to the reservoir line 29 and to the control pressure supply line 9, and is connected by means of a first connecting line 41*a* and a second connecting line 41*b* with the restoring valve 26. The switching valve device 30 has an operating position 30*a* in the form of a closed position 30*a*, in which the first connecting line 41*a* and the second connecting line 41*b* of the restoring valve 26 are cut off. In a safety position 30*b* of the switching valve device 30 in the form of a flow-through position, the control pressure supply line 9 is connected with the first connecting line 41*a* of the restoring valve 26 and the reservoir line 29 is connected with the second connecting line 41*b* of the restoring valve 26. The switching valve device 30 is moved by means of a spring device 31 into the safety position 30*b* in which the hydraulic neutral position control system 25 is activated, and by means of which an electrical actuation device 32, in particular an actuating magnet, can be moved into the operating position 30*a* for the deactivation of the hydraulic neutral position control system 25. The actuation device 32 is thereby in communication with the electronic control device 17 by means of a corresponding control line 33.

In the illustrated neutral position 26*c*, which is the middle position, the restoring valve 26, via corresponding flow restrictor devices, connects the control pressure lines 8*a*, 8*b* with the connecting lines 41*a*, 41*b*. In a first switched position 26*a* of the restoring valve 26, the branch line 28*b* and thus the second control pressure line 8*b* that leads to the second control pressure chamber 7*b* is connected to the first connecting line 41*a*, whereby when the switching valve device 30 is in the safety position 30*b*, the connecting line 41*a* is connected with the control pressure supply line 9. In the first switched position 26*a* of the restoring valve 26, the branch line 28*a* and thus the first control pressure line 8*a* that leads to the first control pressure chamber 7*a* is connected to the second connecting line 41*b* which, when the switching valve device 30 is in the safety position 30*b*, is connected with the reservoir line 29. In a second switched position 26*b* of the restoring valve 26 and when the switching valve device 30 is in the safety position 30*b*, the first branch line 28*a* and thus the first control pressure line 8*a* that leads to the first control pressure chamber 7*a* is connected via the first connecting line 41*a* with the control pressure supply line 9, and the second branch line 28*b* and, thus, the second control pressure line 8*b* that leads to the second control pressure chamber 7*b* is connected via the second connecting line 41*b* to the reservoir line 29.

The restoring valve 26 is in an operative connection via the linkage 27 and the equalization device 40 with the delivery volume control device 3 so that in the illustrated neutral position of the delivery volume control device 3, the restoring valve 26 is moved into the neutral position 26*c*, in which, when the control valve 6*a* is actuated, a positioning pressure present in the first control pressure line 8*a* moves the restoring valve 26 toward the first switched position 26*a* and correspondingly when the control valve 6*b* is actuated when there is a positioning pressure present in the second control pressure line 8*b*, the restoring valve 26 is moved toward the second switched position 26*b*.

The restoring valve 26 can thereby be in the form of a proportional valve that acts as a flow restrictor in intermediate positions.

In place of the switching valve device 30 formed by a switching valve which controls the control pressure supply line 9 and the reservoir line 29, the switching valve device 30 can also be in the form of two separate, electrically actuated switching valves, each with a closed position and an open position, one of which controls the connection of the first connecting line 41*a* with the control pressure supply line 9 and the other of which controls the connection of the second connecting line 41*b* with the reservoir line 29.

With the switching valve device 30, the pump 1 can be switched from the electro-hydraulic position control system with electrical displacement equalization (when the switching device 30 is in the operation position 30*a*) to the hydraulic neutral position control system 25 (when the switching device 30 is in the safety position 30*b*). The electro-hydraulic position control system is formed by the electrically actuated control valves 6*a*, 6*b* and the electrical position feedback circuit 21 and the sensor device 22. By actuation into the safety position 30*b*, the hydraulic neutral position control system 25, having mechanical displacement feedback by means of the restoring valve 26, is mechanically coupled with the cradle.

In FIG. 1, the electrically actuated control valves 6*a*, 6*b* are constantly in communication via the control pressure branch lines 9*a*, 9*b* with the control pressure supply line 9 and via the reservoir branch lines 10*a*, 10*b* with a reservoir. By switching the switching valve device 30 from the operating position 30*a* into the safety position 30*b*, the hydraulic neutral position control system 25 is in an active state in which the swash plate moves back into the neutral position by the hydraulic restoring torque generated by the hydraulic neutral position control system 25. By means of the flow restrictor devices 15*a*, 15*b* in the reservoir branch lines 10*a*, 10*b* and the flow restrictor devices 16*a*, 16*b* in the control pressure branch lines 9*a*, 9*b* of the control valves 6*a*, 6*b*, a volume flow restriction in the admission and discharge of the control valves 6*a*, 6*b* can be achieved, so that the pump 1 can be pivoted back into the neutral position by means of the hydraulic neutral position control system 25.

In FIG. 2, the connection of the control valves 6*a*, 6*b* with the control pressure supply line 9 and the reservoir line 29 can also be controlled by means of the switching valve device 30. For this purpose, the control pressure supply lines 9*a*, 9*b* of the control valves 6*a*, 6*b* and the reservoir branch lines 10*a*, 10*b* of the control valves 6*a*, 6*b* are connected to the switching valve device 30. In the operating position 30*a* of the switching valve device 30, the control pressure supply lines 9*a*, 9*b* of the control valves 6*a*, 6*b* are connected with the control pressure supply line 9. In the operating position 30*a* of the switching valve device 30, the reservoir branch lines 10*a*, 10*b* of the control valves 6*a*, 6*b* are connected to the reservoir line 29. In the safety position 30*b*, the connection of the control pressure supply lines 9*a*, 9*b* of the control valves 6*a*, 6*b* with the control pressure supply line 9 and the connection of the reservoir lines 10*a*, 10*b* of the control valves 6*a*, 6*b* with the reservoir line 29 is cut off.

In the operating position 30*a*, the switching valve device 30 in FIG. 2 thereby cuts off, analogous to FIG. 1, the first connecting line 41*a* and the second connecting line 41*b* of the restoring valve 26, and in the safety position 30*b* connects the control pressure supply line 9 with the first connecting line 41*a* of the restoring valve 26 and the reservoir line 29 with the second connecting line 41*b* of the restoring valve 26.

With the switching valve device 30 illustrated in FIG. 2, in the event of a switchover of the switching valve device 30 from the operating position 30*a* into the safety position 30*b*, the pump 1 can be switched over from the electro-hydraulic position control system with the electrical displacement feedback to the hydraulic neutral position control system 25 with the mechanical displacement equalization.

The pump 1 illustrated in FIGS. 1 and 2 operates as follows. In normal operation of the hydrostatic drive system, the actuation device 32 of the switching valve device 30 is controlled by the electronic control device 17, whereby the switching valve device 30 is moved into the operating position 30*a* and the hydraulic neutral position control system 25 is deactivated, as a result of which the pump 1 is operated with the electro-hydraulic position control system with electrical displacement equalization. On the pump 1 illustrated in FIG. 2, the control valves 6*a*, 6*b* are connected by the switching valve device 30 which is moved into the operating position with the control pressure branch lines 9*a*, 9*b* to the control pressure supply line 9, and with the reservoir branch lines 10*a*, 10*b* to the reservoir line 29.

When the setpoint input device 20 is activated to engage forward travel of the mobile work machine, the electrical control device 17 thereby controls the actuation device 14*a* of the control valve 6*a* corresponding to the actuation of the setpoint input device 20 as the setpoint, whereupon in the first control pressure line 8*a*, a positioning pressure and positioning pressure volume flow that pressurize the first control pressure chamber 7*a* of the positioning piston 5 are generated. The positioning piston 5 thereby generates an actuating torque that pivots the delivery volume control device 3 around the pivot axis S in the first delivery direction 35*a*. The second control pressure chamber 7*b* of the positioning piston 5 is relieved via the control valve 6*b* and the reservoir branch line 10*b* to the reservoir. The position of the delivery volume control device 3 is reported back by means of the sensor device 22 as an actual value to the electronic control device 17, whereby the electronic control device adjusts the delivery volume control device 3 to the setpoint specified by the setpoint input device 20 by a corresponding control of the actuation device 14*a*. The restoring valve 26 is thereby moved by means of the linkage 27 toward the first control position 26*a*, whereby, however, the connecting lines 41*a*, 41*b* are cut off by the switching valve device 30 which is moved into the operating position 30*a*, and the hydraulic neutral position control system 25 is deactivated. In normal traction operation, therefore, the delivery flow of the pump 1 is controlled by the electrical control signal of the actuation device 14 and the control device 4 is operated by an electro-hydraulic position control system with an electrical displacement equalization.

If a failure or malfunction thereby occurs in the drive system or the mobile work machine, such as a power failure, a cable break or a short circuit, for example, the control by the actuation device 32 of the switching valve device 30 ends, as a result of which the switching valve device 30 is moved by means of the spring device 31 into the safety position 30*b*, in which the first connecting line 41*a* is connected with the control pressure supply line 9 and the second connecting line 41*b* is connected with the reservoir line 29. The hydraulic neutral position control system 25 is thereby activated and the control device 4 is switched to the hydraulic neutral position control system 25 with the mechanical position control system. By means of the restoring valve 26 which is moved toward the first control position 26*a*, the first branch line 28*a* and thus the first control pressure chamber 7*a* of the control piston 5 which is pressurized by the positioning pressure is connected to the second connecting line 41*b*, which is connected by means of the switching valve device 30 which is moved into the safety position 30*b* of the reservoir line 29. The branch line 28*b* which leads to the second control pressure chamber 7*b* of the positioning piston 5 is connected to the first connecting line 41*a*, which is connected via the switching valve device 30 with the control pressure supply line 9. In the second control pressure chamber 7*b* of the positioning piston 5, a hydraulic restoring torque is therefore generated which moves the delivery volume control device 3 and pivots it back toward the second delivery direction 35*b*. Because the restoring valve 26 is thereby moved by means of the linkage 27 toward the neutral position 26*c* and thus a mechanical displacement feedback mechanism is formed on the restoring valve 26, there is a mechanically position-controlled and accurate pivoting back of the delivery volume control device 3 of the pump 1 into the neutral position, which is the zero position, whereby as a result of this active and controlled pivoting-back of the pump 1, the mobile machinery can be braked and brought to a stop in a controlled manner.

On the pump 1 illustrated in FIG. 1, on account of the connection of the control valves 6*a*, 6*b* to the control pressure supply line 9 and the reservoir, the hydraulic neutral position control system 25 overdrives the electro-hydraulic position control system. In the embodiment of FIG. 1, the control valves 6*a*, 6*b* and the switching valve device 30 are connected to the control pressure supply line 9 in parallel. During operation of the electro-hydraulic position control system, one of the control valves 6*a*/6*b* will generate a positioning pressure in the assigned control pressure chamber 7*a*/7*b*. When the switching valve device is moved into the safety position 30*b*, the hydraulic neutral position control system 25 is activated to move the pump back to the neutral position. In the active state of the hydraulic neutral position control system 25, the control valve 6*a*/6*b* is still connected to the control pressure supply line 9. Therefore, the control valve 6*a*/6*b* is still in operation and generates a positioning pressure. The activated hydraulic neutral position control system 25 counteracts and overrides the electro-hydraulic position control system in order to move the pump back to the neutral position. On the pump 1 illustrated in FIG. 2, in the safety position 30*b* of the switching valve device 30, the connections of the control valves 6*a*, 6*b* with the control pressure supply line 9 and the reservoir line 29 are cut off, so that the pump 1 can be switched from the electro-hydraulic position control system with the electrical actuation of the control valves 6*a*, 6*b* to the hydraulic neutral position control system 25. In the embodiment of FIG. 2, the switching valve device 30 also controls the connection of the control valves 6*a*, 6*b* to control pressure supply line 9. When the switching valve device 30 is moved into the safety position 30*b*, the hydraulic neutral position control system 25 is activated to move the pump back to the neutral position. In the safety position 30*b*, the switching valve device 30 cuts off the connection of the control valves 6*a*, 6*b* to the control pressure supply line 9 and no positioning pressure can be generated by the control valve 6*a* any further.

In the event of a corresponding actuation of the setpoint input device 20 to initiate reverse travel of the mobile machine, the actuation device 14*b* of the control valve 6*b* is thereby controlled by the electrical control device 17 corresponding to the actuation of the setpoint input device 20 as the setpoint, as a result of which a positioning pressure and positioning pressure volume flow are generated in the second control pressure line 8*b* that pressurize the second control pressure chamber 7*b* of the positioning piston 5. The positioning piston 5 thereby generates an actuating torque that pivots the delivery volume control device 3 around the pivot axis S toward the second delivery direction 35*b*. The first control pressure chamber 7*a* of the positioning piston 5 is relieved via the control valve 6*a* and the reservoir branch line 10*a* to the reservoir. The position of the delivery volume control device 3 is reported back by means of the sensor device 22 as an actual value to the electronic control device 17, whereby the delivery volume control device 3 is adjusted by the electronic control device 17 to the setpoint input at the setpoint input device 30 by a corresponding control of the actuation device 14*b*. The restoring valve 26 is thereby moved by means of the linkage 27 toward the second control position 26*b*, although the hydraulic neutral position control system 25 is deactivated by the switching valve device 30 which is moved into the operating position 30*a*. In normal operation, therefore, the delivery flow of the pump 1 is controlled by the electrical control signal from the activation device 14*b* and the control device 4 is operated with an electro-hydraulic position control system with electrical displacement equalization.

If a failure or malfunction of the drive system or of the mobile machine thereby occurs, such as, for example, a power failure, a cable break or a short circuit, the control of the switching valve device 30 by the actuation device 32 is ended, as a result of which the switching valve device 30 is moved by means of the spring device 31 into the safety position 30*b*, in which the hydraulic neutral position control system 25 is activated and the actuator device is switched over to the hydraulic neutral position control system 25 with the mechanical position control. By means of the restoring valve 26 which is moved toward the second control position 26*b*, the second branch line 28*b* and thus the second control pressure chamber 7*b* of the control piston 5 which is pressurized by the positioning pressure is connected to the second connecting line 41*b*, which is connected by means of the switching valve device 30 which is in the safety position 30*b* to the reservoir line 29. The branch line 28*a* which leads to the first control pressure chamber 7*a* of the positioning piston 5 is connected to the first connecting line 41*a*, which is connected via the switching valve device 30 with the control pressure supply line 9. In the first control pressure chamber 7*a* of the positioning piston 5, a hydraulic restoring torque is thereby produced which moves and pivots the delivery volume control device 3 back toward the first delivery direction 35*a*. Because the restoring valve 26 is thereby moved by means of the linkage 27 toward the neutral position 26*c* and thus a mechanical displacement feedback mechanism is formed on the restoring valve 26, there is a position-controlled and precise pivoting of the delivery volume actuator device 3 of the pump 1 back into the neutral position, which is the zero position, and the mobile machine can be decelerated and brought to a stop in a controlled manner by this active and controlled pivoting back of the pump 1.

The pump 1, on account of the direct generation of a positioning pressure that is generated by the positioning piston device 5 by means of the electrically actuated control valve device 6 and the electrical position feedback circuit 21 formed by the sensor device 22, has an electrically actuatable control device 4 and thus an electro-hydraulic position control system with an electrical displacement equalization of the delivery volume control device 3 that is characterized by a low construction cost. The electrical displacement equalization makes it possible, independently of the variation of the control signal from the actuation devices 14*a*, 14*b* of the control valves 6*a*, 6*b*, to create a pilot opening which determines the dynamic adjustment behavior of the pump regardless of the position of the delivery volume control device 3 so that the pump has an unrestricted variability of the dynamic adjustment behavior. By means of the switching valve device 30, the control device 4 can be switched over to the hydraulic neutral position control system 25 formed by the restoring valve 26 with a mechanical displacement feedback and thus a mechanical position control, so that without additional restoring springs and without slave pistons, in the event of a malfunction or failure, a high hydraulic restoring torque can be generated on the positioning piston device 5 for the active, controlled, and precise pivoting back and thus the return of the delivery volume control device 3 of the pump 1 into the neutral position, which is the zero position and thus a hydraulic, position-controlled neutral position can be reached as a safety function.

This hydraulic position-controlled neutral position of the pump 1 can be easily set from the outside by means of the linkage 27. If an eccentric engagement is realized at the coupling point 42 of the linkage 27 with the equalization device 40, it is easily possible to set and vary the coupling point 42 and the neutral position, which is the zero position, in which the pump 1 has a pivoting angle of 0 degrees of a delivery volume control device 3 which can be in the form of a swashplate, for example, and thus delivers no flow.

By means of the two actuation devices 14*a*, 14*b*, a two-magnet adjustment system for the electrical control device 4 of the delivery volume control device 3 with an electrical position feedback by the sensor device 22 can also be achieved which is independent of the position control circuit of the neutral position and can be dynamically programmed without restriction.

The pump 1 is preferably in the form of an axial piston pump that employs a swashplate construction. In place of the positioning piston device 5 with a double-acting positioning piston as illustrated in FIGS. 1 and 2, for the bidirectional adjustment of the pump 1, two single-acting control pistons can also be used, whereby the first control pressure chamber 7*a* is located on a first positioning piston and the second control pressure chamber 7*b* is located on a second positioning piston.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A hydrostatic pump with variable delivery volume which can be operated in a closed circuit, comprising:

an electrically actuatable control device for control of a delivery volume of the pump, wherein the electrically actuatable control device includes an electrically actuatable control valve device which generates a positioning pressure which acts on a positioning piston device which is in an operative connection with a delivery volume control device of the pump; and an electrical position feedback circuit of the delivery volume control device, wherein the electrically actuatable control device includes a switchable hydraulic neutral position control system, by means of which a restoring torque that moves the delivery volume control device into a neutral position is generated on the positioning piston device.

2. The hydrostatic pump as recited in claim 1, wherein the electrically actuatable control device is switchable between electrical actuation and the hydraulic neutral position control system.

3. The hydrostatic pump as recited in claim 1, wherein the pump is adjustable in both directions in terms of delivery volume, wherein the positioning piston device has a first control pressure chamber which moves the delivery volume control device in a first delivery direction, and a second control pressure chamber which moves the delivery volume control device in a second delivery direction, wherein by means of the electrically actuatable control valve device, a positioning pressure that is present in the first control pressure chamber and the second control pressure chamber is generated.

4. The hydrostatic pump as recited in claim 3, wherein the control valve device has a first control valve which is in communication with a first control pressure line which leads to the first control pressure chamber and a second control valve which is in communication with a second control pressure line that leads to the second control pressure chamber, wherein the first and second control valves are respectively connected with a control pressure supply branch line and a reservoir branch line and by means of each of which an electrical actuation device is actuated.

5. The hydrostatic pump as recited in claim 1, wherein the positioning piston device has two single-acting positioning pistons comprising spring-loaded positioning pistons.

6. The hydrostatic pump as recited in claim 1, wherein the positioning piston device has a dual-action positioning piston comprising a spring-loaded positioning piston.

7. The hydrostatic pump as recited in claim 4, wherein the control valves are movable by a spring device into a control position which connects the control pressure line with the reservoir branch line and are actuated by the actuation device in the direction of a control position that connects the control pressure line with the control pressure supply branch line.

8. The hydrostatic pump as recited in claim 4, wherein the actuation devices are each formed by an actuator magnet.

9. The hydrostatic pump as recited in claim 1, wherein the electrical position feedback circuit of the delivery volume control device has a sensor device which is in an operative connection with the delivery volume control device of the pump, which sensor device is in communication on the input side with an electronic control device which is in connection on the input side with a setpoint input device and on the output side with the electrically actuated control valve device.

10. The hydrostatic pump as recited in claim 1, wherein the switchable hydraulic neutral position control system has a restoring valve which is in an operative connection with the delivery volume control device of the pump, by means of which restoring valve a restoring torque that moves the delivery volume control device into the neutral position is generated on the positioning piston device.

11. The hydrostatic pump as recited in claim 10, wherein the restoring valve is in communication with the first control pressure line and with the second control pressure line and can also be put in communication with a reservoir line and a control pressure supply line.

12. The hydrostatic pump as recited in claim 11, wherein the restoring valve is in an operative connection with the delivery volume control device such that in a neutral position of the delivery volume control device, the restoring valve is in a neutral position, when positioning pressure is present in the first control pressure line it is moved toward a first switching position in which the first control pressure line can be placed in communication with the reservoir line and the second control pressure line can be placed in communication with the control pressure supply line, and when positioning pressure is present in the second control pressure line it is moved toward a second switched position in which the second control pressure line can be placed in communication with the reservoir line and the first control pressure line with the control pressure supply line.

13. The hydrostatic pump as recited in claim 10, wherein the restoring valve is in an operative connection with the delivery volume control device by an equalization device.

14. The hydrostatic pump as recited in claim 13, wherein the restoring valve is connected by a linkage with the equalization device, wherein the neutral position of the delivery volume control device can be set by varying a coupling point of the linkage to the equalization device.

15. The hydrostatic pump as recited in claim 1, including an electrically actuatable switching valve device for switching of the hydraulic neutral position control system.

16. The hydrostatic pump as recited in claim 15, wherein the switching valve device controls connections of the control pressure lines, which can be controlled by the restoring valve, with the reservoir line and the control pressure supply line.

17. The hydrostatic pump as recited in claim 15, wherein the switching valve device controls the connection of the restoring valve with the control pressure supply line and the reservoir line.

18. The hydrostatic pump as recited in claim 15, wherein the restoring valve is in communication by a first connecting line and a second connecting line with the switching valve device and the switching valve device is in communication with the control pressure supply line and the reservoir line.

19. The hydrostatic pump as recited in claim 15, wherein the switching valve device has an operating position, in which the first connecting line of the restoring valve and the second connecting line of the restoring valve are cut off, and has a safety position in which the first connecting line of the restoring valve is connected with the control pressure supply line and the second connecting line of the restoring valve is connected with the reservoir line.

20. The hydrostatic pump as recited in claim 4, wherein the control pressure supply branch lines of the control valves are connected to the control pressure supply line and the reservoir branch lines of the control valves are connected to a reservoir.

21. The hydrostatic pump as recited in claim 4, including a flow restrictor device located in each of the control pressure supply branch lines and/or in the reservoir lines of the control valves.

22. The hydrostatic pump as recited in claim 15, wherein the connection of the control valves with the control pressure supply line and the reservoir line is controlled by the switching valve device.

23. The hydrostatic pump as recited in claim 22, wherein the switching valve device is connected to the control pressure supply branch lines of the control valves and to the reservoir branch lines of the control valves, wherein the switching valve device in the operating position connects the control pressure supply branch lines of the control valves with the control pressure supply line and the reservoir branch lines of the control valves with the reservoir line, and in the safety position cuts off the connection of the control pressure supply branch lines of the control valves with the control pressure supply line and the connection of the reservoir branch lines of the control valves with the reservoir line.

24. The hydrostatic pump as recited in claim 19, wherein in normal operation, the switching valve device is moveable into the operating position and in the event of an operational failure or malfunction is movable into the safety position.

25. The hydrostatic pump as recited in claim 24, wherein the switching valve device is movable by a spring device into the safety position and by an actuating device toward the operating position.

26. The hydrostatic pump as recited in claim 25, wherein the actuating device is an electrical actuating device or a hydraulic actuating device or a pneumatic actuating device or a mechanical actuating device.

27. The hydrostatic pump as recited in claim 25, wherein the actuation device is a switching magnet which is in communication with the electronic control device.

28. A hydrostatic traction drive of a mobile machine comprising a hydrostatic pump as recited in claim 1 and at least one hydrostatic motor connected to the pump in a closed circuit.

* * * * *